US008655003B2

(12) United States Patent
Duisters et al.

(10) Patent No.: US 8,655,003 B2
(45) Date of Patent: Feb. 18, 2014

(54) EARPHONE ARRANGEMENT AND METHOD OF OPERATION THEREFOR

(75) Inventors: Ronald Petrus Nicolaas Duisters, Eindhoven (NL); Sriram Srinivasan, Eindhoven (NL); Cornelis Pieter Janse, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 138 days.

(21) Appl. No.: 13/322,636

(22) PCT Filed: May 27, 2010

(86) PCT No.: PCT/IB2010/052361

§ 371 (c)(1),
(2), (4) Date: Nov. 28, 2011

(87) PCT Pub. No.: WO2010/140087

PCT Pub. Date: Dec. 9, 2010

(65) Prior Publication Data

US 2012/0082335 A1 Apr. 5, 2012

(30) Foreign Application Priority Data

Jun. 2, 2009 (EP) ..... 09161682

(51) Int. Cl.
*H04R 25/00* (2006.01)
*H04R 1/10* (2006.01)
*H04R 5/033* (2006.01)

(52) U.S. Cl.
CPC ..... *H04R 1/1041* (2013.01); *H04R 5/033* (2013.01)
USPC ..... 381/375; 381/71.6

(58) Field of Classification Search
USPC ..... 381/370, 374–376, 380, 71.6; 379/430
See application file for complete search history.

(56) References Cited

U.S. PATENT DOCUMENTS

| | | | |
|---|---|---|---|
| 6,549,635 | B1 | 4/2003 | Gebert |
| 2003/0059075 | A1 | 3/2003 | Niederdrank |
| 2007/0086599 | A1 | 4/2007 | Wilmink |

FOREIGN PATENT DOCUMENTS

| | | | |
|---|---|---|---|
| EP | 1527761 | A1 | 5/2005 |
| WO | 2007097627 | A1 | 8/2007 |

*Primary Examiner* — Tuan D Nguyen

(57) ABSTRACT

An earphone arrangement comprises a microphone (109) which generates a microphone signal and a sound transducer (101) which radiates a first sound component to a user's ear (103) in response to a drive signal. An acoustic channel (111) is further provided for channeling external sound so as to provide a second sound component to the user's ear (103). An acoustic valve (117) allows the attenuation of the acoustic channel (111) to be controlled in response to a valve control signal. A control circuit (105) generates the valve control signal in response to the microphone signal to provide a variable attenuation resulting in a mixed sound of the first sound component and the second sound component reaching the user's ear (103). The combined use of acoustic and e.g. electric signal paths allows improved performance and in particular allows a dynamic trade-off between open and closed earphone design characteristics with respect to external sounds.

14 Claims, 2 Drawing Sheets

EARPHONE ARRANGEMENT AND METHOD OF OPERATION THEREFOR

FIELD OF THE INVENTION

The invention relates to an earphone arrangement and in particular, but not exclusively, to closed and in-ear earphones.

BACKGROUND OF THE INVENTION

The use of personalized audio reproduction has become increasingly widespread with the advent and popularity of portable communication and audio reproduction devices resulting in personalized audio provision in public and shared environments becoming frequent.

In order to provide personalized audio, earphones of some form are typically used. For example, a set of headphones may comprise an earphone for each ear which e.g. may be an in-ear earphone or a closed earphone design surrounding the user's ears. Another example of the use of earphones for providing personalized audio is the use of hearing aids e.g. by hearing impaired users.

Many such earphones are arranged to also provide a passive attenuation of external ambient noise. For example, a well-designed in-ear earphone may reduce the external noise with approximately 25 dB due to the acoustic seal between the ear canal and the acoustic environment. Similarly, out-of-ear closed earphones may also provide a substantial passive attenuation of the external environment, especially for high frequencies.

Such noise reduction may be advantageous in many scenarios. For example, for far-end communication (e.g. over a phone link) in noisy environments, it is preferable to reduce external noise that tends to reduce the intelligibility of the far-end party. As another example, listening to music in noisy environments also tends to be more pleasant when the external noise is reduced, for example in airplanes, busses, trains and crowded public places.

Further, closed or in-ear earphone designs may not only provide attenuation of the external sounds but may also provide an improved quality of the rendered audio due to the close coupling between the earphone and the user's ear. Indeed, in many cases, the closed or in-ear design may be selected due to the audio quality that can be achieved for a given size of the earphone.

However, in many scenarios the attenuation of the external sounds may be disadvantageous. For example, it may not only attenuate undesired noise but may also attenuate desired external sounds.

As an example, the wearing of closed or in-ear earphones in traffic and other situations where attention to the acoustic environment is important may be impractical and indeed the reduction of the external sounds may even lead to dangerous situations. Also, the use of such earphones results in an occlusion effect that is similar to the experience when the ears are blocked (e.g. by water). The occlusion effect drastically reduces the sense of comfort as the ear feels blocked and substantially affects the perception of the user's own voice resulting in a perceived distortion.

As the same earphones are typically used in many different scenarios, the earphone is likely to be suboptimal in some scenarios, and indeed in some scenarios an earphone is likely to not provide enough external sound to the user and in other scenarios it is likely to provide too much external sound to the user.

In order to improve the perceived quality and user experience for a given earphone, a number of signal processing algorithms for processing the signal to be rendered by the earphone have been suggested. For example, active noise cancelling where a microphone measures an ambient noise signal which is used to generate an inverse phase cancelling sound signal from the sound transducer of the earphone has been proposed. As another example, for closed or in-ear headphones, it has been proposed that a microphone may capture external sounds and add these to the sound being reproduced.

However, although such algorithms for modifying the sound reproduced by the sound transducer of the earphone may provide improved performance in many scenarios, they also tend to be suboptimal in some situations and in particular may not provide full flexibility for optimization. Indeed, in some scenarios such approaches may provide a suboptimal audio quality or user experience. The approaches also tend to be relatively complex and to result in increased cost of the earphone system.

Hence, an improved approach would be advantageous and in particular an approach allowing increased flexibility, improved dynamic adaptation to different audio environments and/or use scenarios, improved perceived audio quality, reduced complexity, facilitated operation, facilitated implementation and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided an earphone arrangement comprising: a microphone for generating a microphone signal; a sound transducer arranged to radiate a first sound component to a user's ear in response to a drive signal; an acoustic channel for channeling external sound to provide a second sound component to the user's ear; an acoustic valve for controlling an attenuation of the acoustic channel in response to a valve control signal; and a control circuit for generating the valve control signal in response to the microphone signal to provide a variable attenuation for the acoustic channel resulting in a mixed sound of the first sound component and the second sound component reaching the user's ear.

The invention may provide an improved earphone arrangement in many scenarios. In particular, an earphone that may adapt to different use scenarios and current conditions may be achieved. The earphone may provide an improved mix between direct acoustic sounds from the audio environment and sounds reproduced by the sound transducer.

In particular, the earphone may provide an improved user experience by allowing a dynamic and/or gradual mixing of sound directly from the external audio environment and sound reproduced by the sound transducer. The approach may allow a more flexible, dynamic and gradual trade-off between conflicting requirements such as e.g. noise suppression and reduction of the occlusion effect.

The arrangement may provide improved sound quality and user experience in many embodiments, and may provide an effective interworking between acoustic and electrical characteristics.

The system may allow the sound perceived by the user to be a combination of an electrically controlled sound provided by the sound transducer and a direct acoustically coupled sound from the local audio environment. This may in many scenarios provide a more natural and higher quality sound to be perceived. The earphone arrangement may automatically adapt its operation and the weighting of the two contributions in the mix reaching the user depending on the characteristics in the local audio environment as reflected in the microphone signal.

The earphone arrangement may include any type of earphone including for example an in-ear earphone, a hearing aid, an out-of-ear earphone of a headphone set including both closed and open headphones etc.

In accordance with an optional feature of the invention, the control circuit is arranged to generate the drive signal in response to the microphone signal.

This may provide improved performance in many embodiments and may in particular provide improved perceived audio quality and/or an improved user experience. The drive signal may specifically be generated to include at least a component corresponding to the microphone signal and the first sound component may be generated to reflect the local audio environment. The perception of the external local audio environment may thus be provided as a combination of the sound directly coupled acoustically via the acoustic channel and sound generated electrically via the sound transducer. The approach may allow an improved trade-off between the different characteristics associated with the different paths and may for example allow a trade-off between, and combination of, the natural sound and low complexity (and resource usage) of the acoustic path and the possible complex signal processing of the electrical path.

In accordance with an optional feature of the invention, the control circuit is arranged to jointly generate the drive signal and the valve control signal.

This may provide improved performance in many scenarios and may often lead to optimized performance and trade-off. The joint determination is such that the drive signal is generated taking into account the valve control signal/an acoustic valve characteristic and/or the valve control signal is generated taking into account the drive signal and/or a characteristic of the electrical path.

For example, if the acoustic valve cannot be adjusted to provide a desired effect to the second sound component (such as an acoustic coupling or attenuation), the drive signal may be adapted to provide the desired effect (e.g. by causing the sound transducer to provide additional external sound or to provide a sound canceling signal for the second sound component).

In accordance with an optional feature of the invention, the control circuit is arranged to jointly generate the drive signal and the valve control signal to provide a desired ambient sound characteristic.

This may provide an improved user experience. The desired ambient sound characteristic may e.g. be a level or gain for the ambient sound reaching the user's ear.

In accordance with an optional feature of the invention, the control circuit is arranged to perform noise reduction based on the microphone signal when generating the drive signal and to generate the valve control signal in response to a characteristic of the noise reduction.

This may provide improved noise performance in many embodiments and scenarios. In particular, it may provide an efficient combination of acoustic and electrical noise reduction and/or passive and active noise reduction. The characteristic of the noise reduction may specifically be indicative of a remaining noise component following the noise reduction.

In accordance with an optional feature of the invention, the control circuit is arranged to modify a transfer characteristic for generating the drive signal from the microphone signal in response to an operational characteristic of the acoustic valve.

This may provide improved performance in many scenarios. The transfer characteristic may specifically be a frequency response. The transfer characteristic may for example be modified to reflect a current acoustic transfer function for the acoustic channel. The approach may for example be used to reduce the risk of instability occurring by modifying the transfer characteristic to compensate the overall feedback loop characteristic for changes in the transfer function of the acoustic channel.

In accordance with an optional feature of the invention, the control circuit is arranged to detect an acoustic feedback indication in the microphone signal and to generate at least one of the drive signal and the valve control signal in response to the acoustic feedback indication.

This may provide improved performance in many scenarios and may in particular provide improved stability performance. For example, it may be used to prevent or mitigate acoustic feedback from the sound transducer to the microphone resulting in self-oscillation. The acoustic feedback indication may for example be an indication of a tone signal at a frequency known to be associated with potential acoustic feedback for the earphone arrangement.

In accordance with an optional feature of the invention, the earphone arrangement further comprises means for receiving an audio signal for reproduction by the earphone; and wherein the control circuit is arranged to generate the drive signal in response to the audio signal.

The earphone arrangement may provide an improved user experience when used for reproducing sound of an externally received audio signal. For example, an improved user experience when listening to rendered sound from e.g. a communication device or a media player can be achieved.

The audio signal may be combined with the microphone signal or the first sound component may e.g. correspond only to the received audio signal.

In accordance with an optional feature of the invention, the earphone arrangement further comprises means for receiving an indication of a setting of a further acoustic valve of a remote earphone and wherein the control circuit is arranged to generate the valve control signal in response to the indication.

This may provide improved performance in scenarios wherein more than one earphone is used. For example, for stereo headphones, a left and right earphone may exchange data specifying the setting of the acoustic valve, thereby allowing the sound provided to the listener's two ears to be coordinated.

In accordance with an optional feature of the invention, the control circuit is arranged to align a setting of the acoustic valve with the setting of the further acoustic valve.

This may provide an improved user experience in many scenarios. The alignment may specifically include synchronization such that changes in the settings of the acoustic valves are coordinated. Specifically, a change in the setting of the further acoustic valve may result in a change in the setting of the acoustic valve in response to the received indication.

In accordance with an optional feature of the invention, the control circuit is arranged to introduce an offset between the setting of the acoustic valve and the setting of the further acoustic valve.

This may provide improved performance in many scenarios and may in particular allow for the arrangement to take into account differences in the listener's hearing between the two ears.

In accordance with an optional feature of the invention, the control circuit is arranged to perform an auditory scene analysis on the microphone signal; and to generate the valve control signal in response to the auditory scene analysis.

This may provide improved performance in many scenarios.

In accordance with an optional feature of the invention, the control circuit is arranged to perform a noise analysis in response to the microphone signal and to generate the valve control signal in response to the noise analysis.

This may provide an improved noise performance and may in particular allow an improved noise suppression which specifically may result in a more naturally sounding suppressed noise.

In accordance with an optional feature of the invention, the control circuit is arranged to perform speech detection on the microphone signal and to generate the valve control signal in response to the speech detection.

This may provide an improved user experience in many scenarios. In particular, it may provide an improved noise reduction when the user is listening while reducing the occlusion effect when the user is speaking.

According to an aspect of the invention there is provided a method of operation for an earphone arrangement having an acoustic channel for channeling external sound to provide a first sound component to a user's ear and an acoustic valve for controlling an attenuation of the acoustic channel in response to a valve control signal, the method comprising: generating a microphone signal from a microphone; radiating a second sound component from a sound transducer to a user's ear in response to a drive signal; and generating the valve control signal in response to the microphone signal to provide a variable attenuation of the acoustic channel resulting in a mixed sound of the first sound component and the second sound component reaching the user's ear.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to an earphone of a stereo headphone set comprising an earphone for each ear of a user. However, it will be appreciated that the invention is not limited to this application but may be applied in many other scenarios such as for example to hearing aids.

Figure 1:
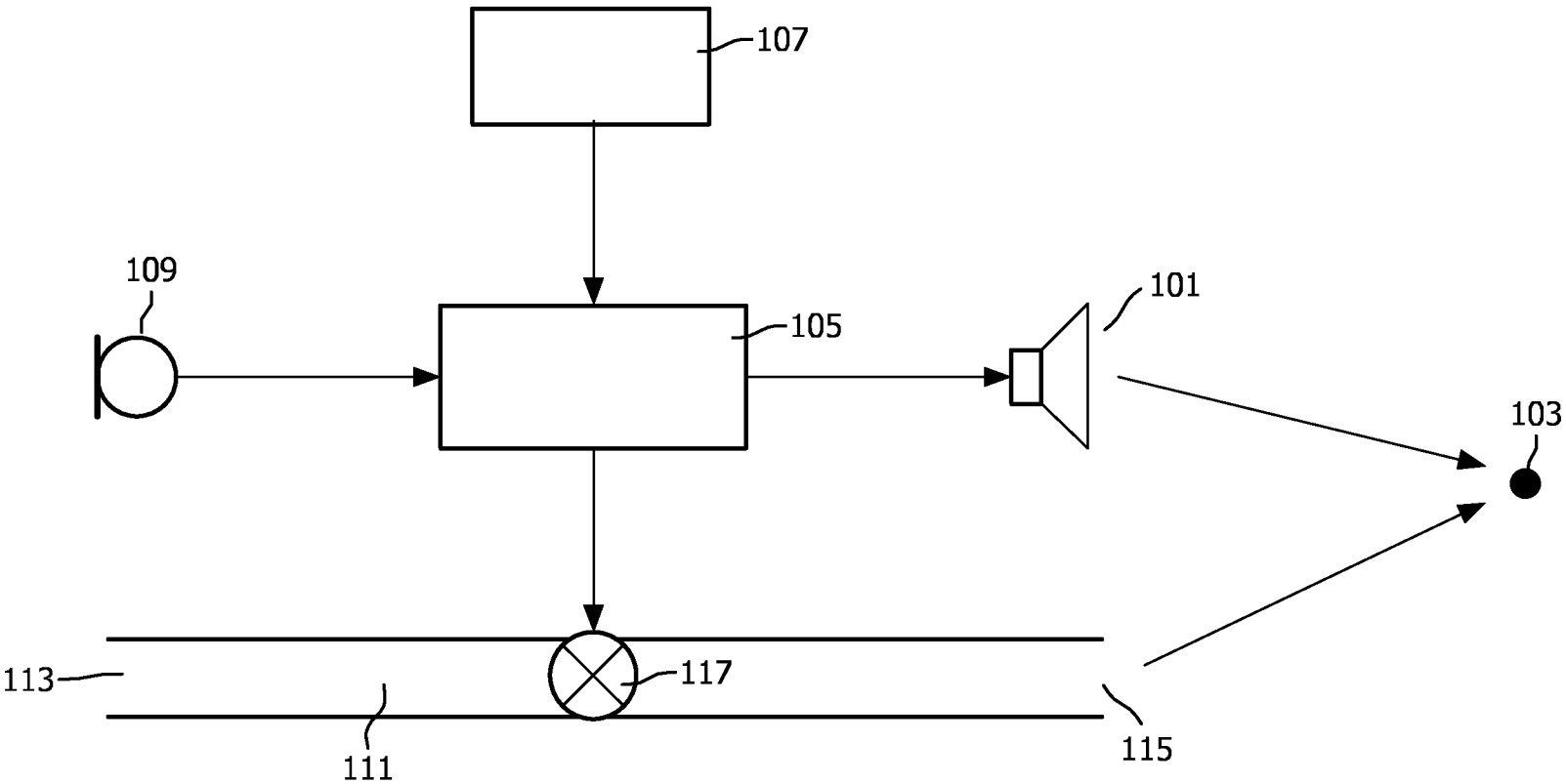
FIG. 1 illustrates an example of an earphone arrangement in accordance with some embodiments of the invention.

FIG. 1 illustrates an example of an earphone arrangement in accordance with some embodiments of the invention. In the example, the earphone arrangement of FIG. 1 is implemented in a single earphone which in use is positioned in or around a user's ear. Specifically, the earphone may be an in-ear earphone which is partly inserted in the user's ear canal or may be a closed earphone and thus may be held in position around the user's ear to form a closed volume. It will also be appreciated that in some embodiments one or more of the elements of FIG. 1 may be located outside the earphone unit. E.g. an external microphone may be used in some embodiments.

The earphone of FIG. 1 corresponds to one earphone of a stereo headset which further comprises a second earphone which may be identical to the earphone of FIG. 1. In other words, FIG. 1 may be considered to illustrate either of the earphones of the stereo headphone.

An earphone may be any device which can render a sound signal to one ear of a user. The earphone is closely coupled to one of the users ears when in use but is not coupled to the user's other ear. Examples of earphones include hearing aids, in-ear earphones, closed earphones etc. Earphones tend to be wearable.

The earphone of FIG. 1 comprises a sound transducer 101 which is arranged to generate an acoustic signal in response to a drive signal being fed to it. The sound transducer 101 radiates a first sound component which can reach a user's ear 103. For example, for an in-ear earphone, the sound transducer 101 directly radiates sound into the ear canal of the user and for a closed earphone it radiates sound into a closed volume enclosing the user's ear. The sound transducer 101 may specifically be a loudspeaker.

The sound transducer 101 is coupled to a control circuit 105 which is arranged to generate the drive signal for the sound transducer 101. Thus, the control circuit 105 generates an electrical drive signal which is fed to the sound transducer 101 to be converted into the first sound component.

The control circuit 105 is further coupled to a signal receiver 107 which is arranged to receive an audio signal from an external or internal source (not shown). The audio signal may be an audio signal that is to be presented by the earphone. For example, it may be an audio signal from a media player that is to be played to the user. The audio signal may be received from any suitable source and in any suitable way. For example, the audio signal may be received as an analog electrical signal via wires coupled to the source. As another example, the signal receiver 107 may comprise a wireless transceiver, such as a Bluetooth™ receiver, and the audio signal may be received as a wireless data signal comprising encoded audio data. In such an example, the signal receiver 107 may include a decoder for decoding the encoded audio data.

The earphone further comprises a microphone 109 which is coupled to the control circuit 105. The microphone 109 is arranged to capture audio in an external audio environment and provide it to the control circuit 105.

In some embodiments, the drive signal may be generated based on the microphone signal from the microphone 109. For example, the microphone 109 may pickup external sounds which are fed to the sound transducer 101 such that the first sound component comprises ambient/external sounds. As another example, the earphone may be used to provide noise reduction/cancellation and the microphone 109 may be located to pick up sound close to the ear of the user. The control circuit 105 may accordingly generate a sound cancellation signal which has the opposite phase of the detected sound. Thus, the first signal component may comprise a noise cancellation sound signal which may cancel at least some of the noise reaching the user.

It will be appreciated that in some embodiments, more than one microphone may be used for the earphone. For example, one microphone may be arranged such that it can capture external sounds and another microphone may be arranged to capture sound close to the ear of the user. The different microphones may be used together, e.g. both the external and the internal microphones may be used to provide noise cancellation, or the microphones may be used differently, e.g. the internal microphone may be used for electric noise cancellation and the external microphone may be used to control the setting of the acoustic valve 117. It will also be appreciated that each microphone may be implemented as a microphone array. This may for example allow a directive characteristic to be achieved by suitably combining the signals from different microphones. Thus, the microphone 109 may in some embodiments be considered to represent a plurality of microphones.

In other embodiments, the drive signal may be generated from the audio signal received from the receiver 107. Thus, the first sound component may correspond to a presentation of the received audio signal. For example, the earphone may be used as part of a headset for presenting sound from a media player or communication unit to a user.

Thus, in some embodiments, the first sound component is based only on the audio signal from the audio receiver 107 and is not dependent on the microphone signal from the microphone 109. In other embodiments, the first sound component is based only on the microphone signal from the microphone 109 and is not dependent on the audio signal from the audio receiver 107. Thus, the audio receiver 107 may be optional and may be included only in some embodiments. It will further be appreciated, that in some embodiments the drive signal will be generated in response to both the audio signal from the audio receiver 107 and the microphone signal from the microphone 109. Thus, the first sound component may include a contribution from both the audio signal and from the microphone signal.

It will be appreciated that the control circuit 105 may be implemented in any suitable way and may specifically be implemented by digital or analogue means. Typically, the control circuit 105 will comprise a digital signal processor arranged to perform suitable digital signal processing algorithms on the received signals. It will be appreciated that the control circuit 105 may accordingly comprise suitable means for analogue to digital and digital to analog conversion where appropriate. It will also be appreciated that the control circuit 105 may comprise other suitable circuitry such as for example low noise amplifiers for the microphone signal and power amplifiers for the drive signal.

In the example, the earphone is a closed earphone or an in-ear earphone. The characteristic of such earphones is that they provide an acoustic attenuation between the external audio environment and the user's ear. This attenuation may be substantial (e.g. typical values of 20-30 dB are not unusual for in-ear earphones). Such attenuation is advantageous in many scenarios where for example passive noise reduction is required or desired. However, in others scenarios it may be undesirable due to the resulting occlusion effect when a user is speaking or due to the external audio environment being of interest to the user.

The earphone of FIG. 1 further comprises an acoustic channel 111 for channeling external sound from the external audio environment to the user's ear 103 thereby providing a second sound component to the user's ear 103. Accordingly, for the earphone of FIG. 1 the sound reaching the user's ear will (predominantly) consist in the two sound components mixed together. Specifically, the sound perceived by the user will be the combination of the first sound component provided by the sound transducer 101 and the second sound component provided by the acoustic channel 111.

The acoustic channel 111 can specifically be generated as a vent connecting a volume surrounding (or within) the user's ear 103 to the external environment. Specifically, a tube or hole may be formed in the earphone with a first opening 113 being outside the earphone and a second opening 115 being in the volume providing the sound to the user's ear 103.

The presence of this acoustic channel allows external sound to reach the user's ear 103 directly through the air medium, i.e. without any conversion into electrical signals. The acoustic channel 111 thus reduces the attenuation of the external sound provided by the earphone and allows this external ambient sound to reach the user's ear 103 with reduced distortion etc. The acoustic channel 111 may accordingly alleviate or eliminate some of the disadvantages that can be experienced for a closed or in-ear earphone design. For example, it may reduce the occlusion effect and allow ambient sounds to be heard by the user. However, the presence of the acoustic channel 111 may reduce the passive noise reduction provided by the closed or in-ear earphone design. The presence of the acoustic channel 111 may specifically result in an earphone design more akin to an open headphone design.

The earphone of FIG. 1 furthermore comprises an acoustic valve 117 which is arranged to control the attenuation of external sound radiation through the acoustic channel 111 in response to a valve control signal. Specifically, the acoustic channel 111 may be equipped with an acoustic valve 117 that can gradually vary the cross-section of at least part of the acoustic channel 111. Dependent on the applied control signal, the acoustic valve 117 may gradually open or close the acoustic channel 111 and may specifically be arranged to vary the opening of the acoustic channel 111 all the way from it being completely open to it being completely closed.

The acoustic valve 117 can thus be used to control how much passive attenuation is provided by the earphone and how much direct acoustic ambient sound is allowed to be passed to the user.

The acoustic valve 117 is coupled to the control circuit 105 which provides the valve control signal. The control circuit 105 generates the valve control signal in response to the microphone signal. The control signal is thus used to provide a variable attenuation for the acoustic channel 111 such that this results in a mixed sound of the first sound component and the second sound component reaching the user's ear 103.

The attenuation of the acoustic channel 111 may thus be a gradual attenuation which allows some sound to reach the user's ear 103 acoustically while still allowing the earphone to provide some passive attenuation. Thus, the described approach may provide a much more flexible and dynamic variation of the passive attenuation of the earphone dependent on the audio captured up by the microphone 109.

For example, if the microphone 109 is arranged to capture the external ambient sound, the exact attenuation of the sound may be adjusted to reflect the characteristic of this sound.

As a specific example, the earphone of FIG. 1 may be used to present the audio signal received by the receiver 107. At the same time, the control circuit 105 may evaluate the microphone signal picked up by the microphone 109 and control the attenuation of the acoustic channel 111 dependent on this by generating a suitable valve control signal for the acoustic valve 117. The control circuit 105 may for example determine the level of the ambient noise and may control the acoustic valve 117 to be dependent on the level of the external sound. For example, if the external sound level is very low, the control circuit 105 may proceed to generate a control signal which results in the acoustic valve 117 being fully open. In this case, the attenuation associated with the acoustic channel 111 will be very low and the second signal component may correspond to an accurate and not attenuated external sound signal. Thus, when the user is in a quiet environment he or she will be able to listen to the presented audio while not being subjected to any of the disadvantages associated with a closed or in-ear earphone design. For example, the user will not experience any occlusion effect and will be able to hear external sound sources (e.g. the user will be able to hear if he is called by another person). However, if the ambient sound level increases because the user moves to a noisy audio environment, this may be captured by the microphone 109 and the control circuit 105 may accordingly proceed to gradually close the acoustic valve 117 to compensate for the increased ambient sound level. Thus, the user may still be able to hear the presented audio with the level of background external sounds being low as these have been attenuated in the acoustic channel 117. However, this attenuated sound level is achieved at the expense of e.g. increasing the occlusion effect. If the ambient sound levels become so loud that the acoustic valve 117 is fully closed corresponding to the passive attenuation of the earphone being maximized, the control circuit 105 may in some embodiments proceed to perform active noise cancellation such that the sound radiated from the sound transducer 101 not only comprises the audio signal from the receiver 107 but also comprises a noise cancelling signal for the external noise. In this example, the determination of the external sound level may be considered a simple noise analysis for the microphone signal.

Thus, the earphone of FIG. 1 may provide an improved and flexible user experience where the operation is automatically adapted to the specific conditions experienced by the user. Indeed, the approach may be seen to provide a flexible adaptation of the earphone design from an open design to a fully closed/in ear design. Thus, the system allows for a single earphone to adapt to provide the desired characteristics for the current usage scenario.

In particular, the close co-operation between electrical an acoustic sound components is used to provide the appropriate audio experience for the current conditions thereby providing e.g. an improved perceived audio quality. Indeed, the approach allows for both the first sound component and the second sound component to be simultaneously audible to the user to provide an improved audio experience e.g. comprising both an audio signal to be rendered and external sounds at a desired level. Furthermore, undesired effects such as occlusion can be reduced and in particular can be limited to scenarios where they are a necessary trade-off.

Thus, in contrast to approaches such as that of United States Patent Application US2007/0086599 which discloses an example of an acoustic valve being used to fully open or fully close a vent of an earplug in order to switch the earplug between fully transparent and fully blocked, the described approach provides an earphone that can be used to provide an advantageous presentation of audio, e.g. from an audio signal. The system provides a flexible and variable adaptation such that the user perception of the rendered sound is optimized by the first and second sound components cooperating to provide the possibly optimized audio experience for the current conditions.

It will be appreciated that the acoustic valve 111 may be any function that can vary the attenuation for sound signals through the acoustic channel 111. Specifically, the acoustic valve 117 may be any functionality that can vary the cross-section of the acoustic channel 111.

As a specific example, the acoustic valve 117 may be implemented as a diaphragm shutter (similar to the one used in a photographic camera), using e.g. a small stepper motor to control the opening. Another example could be the way it is implemented in a radiator valve where the flow can be obstructed by an object that is pushed into the tube. The position of the blocking object can be controlled by an electric and/or magnetic field or by a piezo actuator, for example.

In the specific example mentioned above, the earphone is used for presenting an audio signal and the control circuit 105 specifically generates the drive signal depending on the audio signal. In this example, the microphone 109 may not be arranged on the external side of the earphone in order to pick up external noise but may in some embodiments be arranged such that it captures sound in a volume formed around the ear by a closed headphone. Thus, in this example, the microphone 109 does not capture the external sound directly but rather measures the sound that is received by the user's ear 103. The microphone signal may accordingly reflect the combined contribution of the first and second sound components.

The control circuit 105 may proceed to perform noise analysis on the microphone signal 109. For example, it may subtract a signal component corresponding to the first sound component and then evaluate the remaining residual signal. The signal may directly be considered to correspond to an undesired noise component and the control circuit 105 may proceed to open or close the acoustic valve 117 depending on the level of this residual signal. For example, if the level is above a threshold the acoustic valve 117 is closed further and if it is below the threshold the acoustic valve 117 is opened further. Thus, in this example a feed back loop is provided to adjust the acoustic valve 117 to maintain the noise level at the user's ear 103 below a given value.

In some embodiments, the control circuit 105 may furthermore proceed to perform a more advanced evaluation of the residual signal. For example, it may proceed to separate speech components and noise components and to use these estimates to control the acoustic valve opening.

In other embodiments the drive signal for the sound transducer 101 is additionally or alternatively generated from the microphone signal. For example, the microphone signal may be used to perform active noise cancellation wherein a sound component is radiated from the sound transducer 101 in order to cancel an undesired sound component. It will be appreciated that such functionality may be independent of whether the sound transducer 101 is also used to present an audio signal received from the audio receiver 107 or not. Thus, the first sound component may in some cases be generated to comprise both an audio signal sound component corresponding to the audio signal from the audio receiver 107 and a sound cancelling component generated from the microphone signal and intended to cancel external sounds.

The following specific examples will for clarity and brevity focus on an embodiment wherein the earphone is used purely for noise reduction or cancellation and does not render any sound. Thus, in the examples, no audio signal is received and the first sound component comprises only the sound cancelling component.

In some of these embodiments, the control circuit 105 may jointly generate the drive signal and the valve control signal. Thus, the valve control signal may depend on the drive signal and/or the drive signal may depend on the valve control signal. Thus, in these embodiments the desired operation of the earphone is achieved by carefully controlling both the sound generated by the sound transducer 101 and the sound provided via the acoustic channel 111. Thus, the two different paths are controlled together and are optimized together to provide improved performance.

As an example, the control circuit 105 may seek to maintain a given desired external sound characteristic, such as e.g. a given maximum external sound level. In such a scenario, if the microphone detects that the current ambient sound level is very low, the control circuit 105 may proceed to fully open the acoustic valve 117 and to generate a zero value drive signal resulting in no sound cancellation signal being generated from the sound transducer 101. However, if the detected external sound level increases, the control circuit 105 may proceed to introduce both active and passive noise cancellation together. The passive noise cancellation is achieved by gradually closing the acoustic valve 117 in order to increase the attenuation of the acoustic channel 111 and thus the passive attenuation of the earphone as a whole. At the same time, the control circuit 105 may proceed to generate a sound cancelling drive signal that results in a sound cancelling sound component been radiated from the sound transducer 101. The relative effects of each of the two sound reduction approaches may be varied as a function of the external sound level. Indeed, typically an active sound cancellation procedure tends to be suboptimal and may even introduce some artefacts. Therefore, at low sound levels, the level of active noise cancellation may be maintained relatively low thereby allowing most of the attenuation to be provided by the increased attenuation of the acoustic channel 111. However, at higher sound levels, the active noise reduction may be increased substantially in order to provide a more effective and substantial noise cancellation. However, it may still be advantageous to maintain the acoustic channel 111 partially open as this may in many scenarios provide a more naturally sounding residual sound.

As another example, the control circuit 105 may be arranged to perform a noise reduction based on the microphone signal and may then adjust the valve control signal depending on a characteristic of this noise reduction. For example, the acoustic valve 117 may be opened or closed depending on the amount of noise that remains after the active cancellation.

For example, in some embodiments an active noise cancellation may be optimized and specifically targeted at a specific characteristic sound. For example, the earphone may be used for hearing protection for a worker operating a noisy machine. The active noise cancellation may thus be specifically optimized for the sound generated by this machine, e.g. the machine may have a specific frequency response with energy concentrated in one or more peaks that can be effectively cancelled by the active noise cancellation.

In this case, the active noise cancellation may be highly effective in cancelling a potentially loud sound from the specific machine but may be very inefficient at cancelling other types of noise. Thus, during normal operation when the user is mainly subjected to the noise from the machine, the active noise cancellation may effectively cancel the noise and the acoustic channel 111 may be kept open to allow the user to hear other sound sources. However, if the user moves to a different environment wherein other noise sources become dominant (e.g. if the worker temporarily moves from his machine to another type of machine), the active noise cancellation algorithm may become very inefficient resulting in a large residual noise component. This may be detected by the control circuit 105 (e.g. simply by a level detection for a microphone 109 located close to the user's ear 103) and accordingly the control circuit 105 may proceed to close the acoustic valve 117 to increase the attenuation of the acoustic channel 111. Thus, the system may automatically adapt to provide passive noise cancellation when it detects that the active noise cancellation is insufficient.

It will be appreciated that the described approach of combining electrical and acoustic paths to provide a given sound reaching the user's ear can be used in many different ways and that the above examples merely illustrate some possible uses.

It will also be appreciated that in many embodiments, the earphone may be arranged to provide different characteristics in different situations. For example, the earphone may be arranged to operate in different modes with each mode providing the desired characteristics for the specific use. For example, the earphone may be able to switch between the following different modes:

Safe Mode/Transparent Mode

In this mode the acoustic channel 111 is fully open and all sounds from the external environment can be heard. Occlusion is minimal, and comfort is good. Indeed, the earphone may provide characteristics corresponding to an open design. In some embodiments a desired perceived ambient sound level can be generated by trading off the acoustical and electrical sound components in order to provide a personalization of the earphone. In this mode, audio may e.g. be played through the sound transducer 101 e.g. allowing the earphone to be used for a voice communication.

Noise Reduction Mode

In this mode, the acoustic channel may be closed and external noise is reduced. In this mode, audio may also be played through the loudspeaker e.g. supporting a voice communication. If necessary, active noise reduction may be applied using the external microphones.

Face-to-Face Communication Mode

This mode is used to enable an improved face-to-face communication when the headphones are used in noisy environments. The noise may e.g. be reduced by closing the acoustic valve 117 and the desired source may be processed by audio enhancement algorithms. For example, directional signal processing and noise suppression may be applied based on a plurality of microphones to generate a signal which is more legible.

As another example of the co-operation between the acoustic and electric paths, the control circuit 105 may be arranged to modify a transfer characteristic from the microphone signal to the drive signal in response to an operational characteristic for the acoustic valve 117.

For example, dependent on the valve control signal or a measured characteristic for the acoustic valve 117, the control circuit 105 may proceed to modify the way it generates the drive signal from the microphone signal. For example, the control circuit 105 may proceed to change the frequency response for the signal path generating (at least partially) the drive signal from the microphone signal. This may for example be used to provide an improved sound quality at the user's ear 103. As a specific example, the earphone may be used as part of a hearing aid wherein the sound from the acoustic channel 111 is mixed with the sound from the sound transducer 101 to provide an enhanced audio signal. For example, certain frequency intervals may be amplified for the first signal component such that this enhances the perception for the hearing impaired user. In such an example, the acoustic valve 117 may be controlled dependent on the frequency spectrum of the microphone signal.

As a specific example, the hearing-impaired user may have a good hearing for high frequency components whereas low-frequency components may be less perceptible to the user and may even degrade the perception of higher frequencies. When the external sound has a characteristic that corresponds to a high concentration of signal energy at high frequencies and a low concentration of signal energy at low frequencies, the sound may be fed acoustically to the user by the acoustic channel 111. In addition, it may be further enhanced by the first sound component which specifically may be generated using a flat frequency response corresponding to a mere level increase.

However, if the external sound is characterized by having a high concentration of signal energy at low frequencies and a low concentration of signal energy at high frequencies, the external sound may not be perceptible to the hearing-impaired user. Accordingly, the control circuit 105 may detect this frequency distribution and proceed to increase the attenuation of the acoustic channel 111 by further closing the valve 117. This will reduce the signal level of the second sound component thereby preventing that the high energy concentration at low frequencies makes perception more difficult for the user. In addition, the control circuit 105 not only generates an amplified drive signal that results in the first sound component having an increased level but also applies a high pass filtering that substantially attenuates the lower frequencies relative to the higher frequencies. Accordingly, this results in an improved perception by the hearing-impaired user resulting from both the increased attenuation of the acoustic channel 111 and the high pass filtering for the drive signal.

Such an application may for example be suitable for a hearing-impaired user who is able to understand female and children's voices but has difficulties in understanding a male speaker.

As another example, the response may be modified to provide an improved stability of the system. For example, if the microphone 109 is capturing external sound, a feedback path exists from the sound transducer 101 to the microphone 109 via the acoustic valve 117. The characteristic of this feedback path is dependent on the setting of the acoustic valve 117 and accordingly the stability criterion for avoiding a positive feedback situation to occur depends on the setting of the acoustic valve 117. Accordingly, the frequency response for the generation of the drive signal from the microphone signal may be modified to provide a suitable stability margin for the current setting of the acoustic valve 117.

In some embodiments the control circuit may be arranged to detect an acoustic feedback indication in the microphone signal and may modify the generation of the drive signal and/or the valve control signal based on this indication.

Specifically, an acoustic feed back resulting in a self oscillation tends to be characterized by introducing a single tone component. The emergence of such a tone component in the microphone signal may be detected by the control circuit 105. Indeed, typically it can be determined that such a tone component will occur within a small frequency interval and the control circuit 105 may therefore be arranged to detect the emergence of any significant tone components within this small frequency interval. If the control circuit 105 detect such a time component it may proceed to reduce the gain for the generation of the drive signal and/or to modify the valve control signal to increase the attenuation of the acoustic channel 111 thereby removing the instability conditions.

In some embodiments, the control circuit 105 may be arranged to perform an auditory scene analysis on the microphone signal. The valve control signal may then be generated dependent on the results of this auditory scene analysis. In some embodiments, the generation of the drive signal may also be in response to the results of the auditory scene analysis.

Thus, the attenuation of the acoustic channel 111 and the generation of the first sound component may be automatically determined or influenced by an auditory scene analysis. For example, if there is a lot of background noise, the control circuit 105 may decide that the intelligibility of the sound received by the user will improve if the acoustic channel is closed more.

An auditory scene analysis can be performed by applying a time-frequency analysis to the microphone signal, separating auditory objects and feeding the objects to a classifier. The time-frequency analysis may for example be performed by an auditory model. The classifier is trained using a variety of sounds and will determine the class of the auditory object. The control circuit 105 may then decide its response based on the class of the object. For example, certain traffic sounds will be classified as important desired signals and thus be allowed to pass to the user's ear 103. Babble noise in a pub may be classified as an undesired signal and suppressed as much as possible. Using multiple microphones, preferably on devices on both ears for effective spatial separation, this analysis can also be performed to take into account spatial characteristics of the auditory objects in the scene.

In some embodiments, the control circuit may be arranged to perform speech detection on the microphone signal and to generate the valve control signal in response to the speech detection.

It will be appreciated than any suitable speech detection may be used without detracting from the invention. The control circuit 105 may specifically proceed to open the acoustic valve 117 when the speech detector is indicative of the user currently speaking and may proceed to close the acoustic valve when the speech detector is indicative of the user not speaking.

This may allow an efficient passive attenuation of external sounds when the user is listening while at the same time avoiding the occlusion effects which many users find particularly unpleasant. Thus, the approach may provide efficient external noise suppression while avoiding the distorted perception of the user's own voice. Such an approach may be particularly advantageous when the earphone is used for e.g. two-way voice communications.

In some embodiments, the generation of the drive signal from the microphone signal may for example comprise a simple filtering and/or amplification allowing the two sound components to both provide relatively clear representations of the ambient external noise. However, in other embodiments, the control circuit 105 may be arranged to perform e.g. complex processing that substantially modifies the presented signals. Thus, in some embodiments, the control circuit 105 may modify the microphone signal when generating the drive signal such that a characteristic is substantially changed relative to the acoustic signal via the acoustic channel 111. For example, the electrical signal may be delayed or head-related transfer functions may be applied in the electrical path. This may for example be used to provide various spatial effects, such as e.g. a widening of the stereo image.

The previous description has focused on a single earphone. However, in many embodiments the earphone will be used together with a second earphone for the user's other ear. The second earphone may in many cases be identical to the first earphone and may accordingly also comprise an acoustic channel with an adjustable acoustic valve.

In such embodiments, the two earphones may comprise functionality for exchanging control data that defines the setting of the acoustic valve. This may allow the two earphones to coordinate the settings to provide linked performance. It will be appreciated, that the communication may be a two-way communication with data being exchanged in both directions or may be a one-way communication wherein only one earphone provides data to the other earphone.

Figure 2:
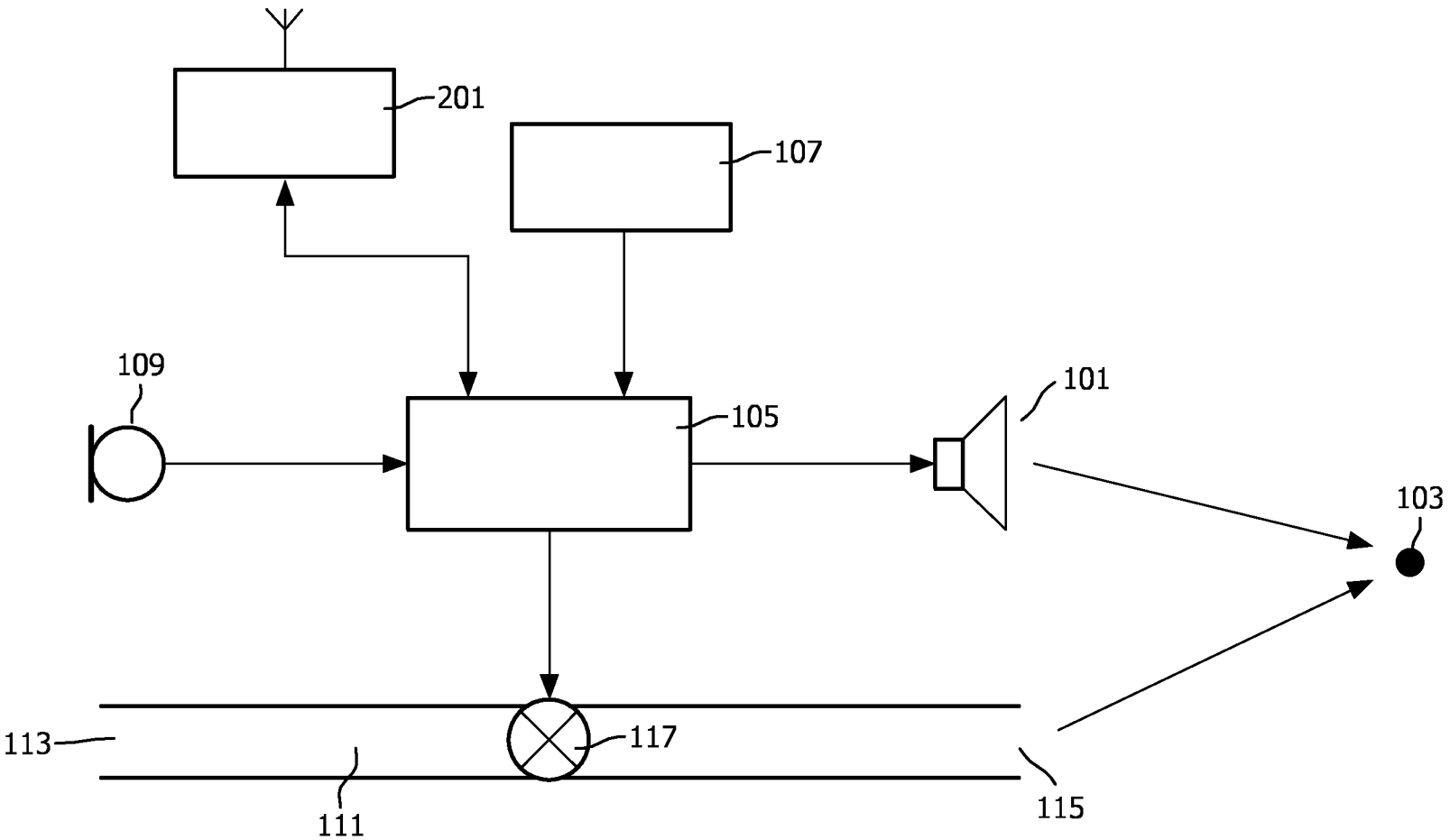
FIG. 2 illustrates an example of an earphone arrangement in accordance with some embodiments of the invention.

FIG. 2 illustrates how the earphone of FIG. 1 may be enhanced to comprise a transceiver 201 which is arranged to exchange data with another earphone (which may comprise an equivalent transceiver). In the example, the transceiver 201 is a short range wireless transceiver such as a Bluetooth™ transceiver. However, it will be appreciated that in other embodiments other communication means may be used and that for example the two earphones may be communicating via a wired connection.

The control circuit 105 in at least one of the two earphones is accordingly arranged to provide an indication of the setting of its acoustic valve 117 to the transceiver 201. The transceiver 201 of this earphone then transmits the indication to the other earphone where it is received by the transceiver 201. The transceiver 201 of this earphone then proceeds to forward the indication to its local control circuit 105 which then proceeds to take the setting of the acoustic valve 117 of the remote earphone into account when generating the valve control signal for its own acoustic valve 117.

The control circuit 105 can specifically proceed to align the setting of the local acoustic valve 117 to that of the acoustic valve of the other earphone. This alignment may specifically be a synchronization such that when the valve setting is changed at the other earphone, a corresponding change is also made at the local earphone.

The alignment may specifically be such that the setting is the same in both earphones i.e. such that symmetric performance and operation is achieved. However, in some embodiments, the control circuit may introduce an offset between the settings of the acoustic valves of the two earphones. This offset may be a fixed static value or may be determined in response to other parameters. The use of such an offset may in particular allow a customization of the operation to the specific user and may for example be set to reflect asymmetries in the user's hearing ability for the two ears.

In some embodiments, the indication of the setting of the acoustic valve of the remote earphone may be a direct setting indication for the acoustic valve of the local acoustic valve determined by the control circuit 105 of the remote earphone. Thus, in some embodiments, the control circuit 105 of one of the earphones may determine valve control signals for both earphones and may communicate one of these to the other earphone which simply proceeds to implement the indicated setting.

It will be appreciated that the above description for clarity has described embodiments of the invention with reference to different functional circuits, units, and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of circuits, means, elements or method steps may be implemented by e.g. a single unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. An earphone arrangement comprising:

a microphone for generating a microphone signal;

a sound transducer arranged to radiate a first sound component to a user's ear in response to a drive signal;

an acoustic channel for channeling external sound to provide a second sound component to the user's ear;

an acoustic valve for controlling an attenuation of the acoustic channel in response to a valve control signal;

a control circuit for generating the valve control signal in response to the microphone signal to provide a variable attenuation for the acoustic channel resulting in a mixed sound of the first sound component and the second sound component reaching the user's ear; and means for receiving an indication of a setting of a further acoustic valve of a remote earphone, wherein the control circuit is arranged to generate the valve control signal further in response to the indication of the setting of the further acoustic valve of the remote earphone.

2. The earphone arrangement of claim 1, wherein the control circuit is arranged to generate the drive signal in response to the microphone signal.

3. The earphone arrangement of claim 2, wherein the control circuit is arranged to jointly generate the drive signal and the valve control signal.

4. The earphone arrangement of claim 3, wherein the control circuit is arranged to jointly generate the drive signal and the valve control signal to provide a desired ambient sound characteristic.

5. The earphone arrangement of claim 2, wherein the control circuit is arranged to perform noise reduction based on the microphone signal when generating the drive signal and to generate the valve control signal in response to a characteristic of the noise reduction.

6. The earphone arrangement of claim 2, wherein the control circuit is arranged to modify a transfer characteristic for generating the drive signal from the microphone signal in response to an operational characteristic of the acoustic valve.

7. The earphone arrangement of claim 2, wherein the control circuit is arranged to detect an acoustic feedback indication in the microphone signal and to generate at least one of the drive signal and the valve control signal in response to the acoustic feedback indication.

8. The earphone arrangement of claim 1, further comprising means for receiving an audio signal for reproduction by the earphone; and wherein the control circuit is arranged to generate the drive signal in response to he audio signal.

9. The earphone arrangement of claim 1, wherein the control circuit is arranged to align a setting of the acoustic valve with the setting of the further acoustic valve.

10. The earphone arrangement of claim 1, wherein the control circuit is arranged to introduce an offset between the setting of the acoustic valve and the setting of the further acoustic valve.

11. The earphone arrangement of claim 1, wherein the control circuit is arranged to perform an auditory scene analysis on the microphone signal; and to generate the valve control signal in response to the auditory scene analysis.

12. The earphone arrangement of claim 1, wherein the control circuit is arranged to perform a noise analysis in response to the microphone signal and to generate the valve control signal in response to the noise analysis.

13. The earphone arrangement of claim 1, wherein the control circuit is arranged to perform speech detection on the microphone signal and to generate the valve control signal in response to the speech detection.

14. A method of operation for an earphone arrangement having an acoustic channel for channeling external sound to provide a first sound component to a user's ear and an acoustic valve for controlling an attenuation of the acoustic channel in response to a valve control signal, the method comprising:

generating a microphone signal from a microphone;

radiating a second sound component from a sound transducer to a user's ear in response to a drive signal;

generating the valve control signal in response to the microphone signal to provide a variable attenuation of the acoustic channel resulting in a mixed sound of the first sound component and the second sound component reaching the user's ear; and receiving an indication of a setting of a further acoustic valve of a remote earphone, wherein generating the valve control signal further includes generating the valve control signal in response to the indication of the setting of the further acoustic valve of the remote earphone.

* * * * *